US009174252B2

(12) United States Patent
Kim

(10) Patent No.: US 9,174,252 B2
(45) Date of Patent: Nov. 3, 2015

(54) DEVICE FOR CLEARING PIPE BLOCKAGE

(71) Applicant: Yong Soo Kim, Changwon-si (KR)

(72) Inventor: Yong Soo Kim, Changwon-si (KR)

( * ) Notice: Subject to any disclaimer, the term of this patent is extended or adjusted under 35 U.S.C. 154(b) by 0 days.

(21) Appl. No.: 14/666,652

(22) Filed: Mar. 24, 2015

(65) Prior Publication Data

US 2015/0273541 A1 Oct. 1, 2015

(30) Foreign Application Priority Data

Mar. 25, 2014 (KR) ..... 10-2014-0034903
Feb. 5, 2015 (KR) ..... 10-2015-0018006

(51) Int. Cl.
*E03D 9/00* (2006.01)
*B08B 9/055* (2006.01)
*E03C 1/308* (2006.01)

(52) U.S. Cl.
CPC ..... *B08B 9/055* (2013.01); *B08B 9/0557* (2013.01); *E03C 1/308* (2013.01)

(58) Field of Classification Search
CPC ..... E03C 1/308; B08B 9/055; B08B 9/0557
USPC ..... 4/255.01–255.03
See application file for complete search history.

(56) References Cited

U.S. PATENT DOCUMENTS 1,515,212 A * 11/1924 Kasper ..... 295/22
5,102,415 A 4/1992 Guenther
5,823,754 A * 10/1998 Lee ..... 4/255.08
6,286,172 B1 9/2001 Castagnoli

OTHER PUBLICATIONS

Korean Office Action (Korea Patent Application No. 10-2014-0034903), May 26, 2014.

* cited by examiner

*Primary Examiner* — Tuan N Nguyen
(74) *Attorney, Agent, or Firm* — Park & Associates IP Law, P.C.

(57) ABSTRACT

A device for clearing pipe blockage includes: pumping means (A) for compressing air by pumping and having an outlet (18) for discharging compressed air out; and an inflatable balloon mounted at the outlet and expanding by air discharged through the outlet. The outlet is a one-way valve, and a cylindrical guide member (24) is formed to surround the outside of the inflatable balloon, guides the inflatable balloon to move forward inside a pipe when a front end part of the guide member is inserted into the pipe, and is made of flexible material. A presser which cleans the inner surface of the pipe while moving in a state where it gets in contact with the inner surface of the pipe is mounted at a front end of the inflatable balloon, and the blocked pipe is cleared by shock pressure by movement of the pumping unit and a change in pressure by expansion of the inflatable balloon by the compressed air.

7 Claims, 3 Drawing Sheets

DEVICE FOR CLEARING PIPE BLOCKAGE

REFERENCE TO RELATED APPLICATIONS

This application claims the priority benefit of Korean Patent Application No. 10-2014-0034903 filed on Mar. 25, 2014, and Korean Patent Application No. 10-2015-0018006 filed on Feb. 5, 2015, the entire contents of which are incorporated herein by reference

FIELD OF THE INVENTION

The present invention relates to a device for clearing blockage of a pipe which drains water of a toilet or a sin, and more particularly, to a device for clearing blockage of a pipe which can clear the inside of a blocked pipe using a balloon expanding by injection of air.

BACKGROUND OF THE INVENTION

In general, toilets, washstands and sinks are designed to discharge foreign matters out when water is drained. Moreover, because a part to drain water adopts a U-shaped trap structure in order to prevent a bad smell from backing up, such a trap structure causes pipe blockage. In addition to such a structural reason, of course, pipes of the toilets, washstands and sinks are frequently blocked by relatively large-sized foreign matters.

Now, various devices for clearing blockage of a pipe come on the market, but it is difficult to effectively clear the blockage using such devices. The difficulty in effectively clearing the blocked pipe using the conventional devices may be caused by that sufficient shock or pressure is not applied to the blocked part. For instance, when a predetermined pressure is applied from the outside to the inside of a toilet in a bathroom, the conventional devices do not provide sufficient airtightness between the outside and the inside of the toilet and cannot effectively generate or transfer pressure to the pipe connected from the inside of the toilet.

SUMMARY OF THE INVENTION

Accordingly, the present invention has been made to solve the above-mentioned problems occurring in the prior arts, and it is an object of the present invention to provide a device for clearing pipe blockage which can supply sufficient pressure to the inside of a blocked pipe without any loss of pressure, thereby clearing the blocked pipe.

To accomplish the above object, according to the present invention, there is provided a device for clearing pipe blockage including: pumping means which can compress air by pumping and has an outlet for discharging compressed air out; an inflatable balloon which is mounted at the outlet and expands by air discharged through the outlet; a one-way valve which is mounted at the outlet to supply the air compressed by the pumping means to the inflatable balloon and to stop a flow of the air in the reverse direction; and a guide member which is formed in a cylindrical shape to surround the outside of the inflatable balloon, guides the inflatable balloon expanding by the pumping means to move forward inside a pipe, and is made of a flexible material, wherein the inflatable balloon expanding by the pumping means expands to the inside of the pipe, which is blocked, to maintain an airtight state at an inlet of the pipe, so that the blocked pipe is cleared by shock pressure by movement of the pumping unit and a change in pressure by expansion of the inflatable balloon by the compressed air.

In the present invention, the inflatable balloon expands in a state where the guide member is inserted into the inlet of the pipe to a predetermined length. Moreover, the inflatable balloon expands in a state where the guide member comes into contact with the inlet of the pipe.

According to the preferred embodiment of the present invention, the device for clearing pipe blockage further includes a presser which is mounted at a front end portion of the inflatable balloon to clean the inner surface of the pipe while moving in a state where it gets in contact with the inner surface of the pipe.

According to the preferred embodiment of the present invention, the guide member is formed in a cylindrical shape which has a slit formed in the longitudinal direction and includes an auxiliary guide attached to the inside of the slit to cover an open part of the guide member when the guide member is opened by the slit, such that the guide member can be used widely regardless of sizes of the pipe.

Moreover, the guide member has an inner end portion formed in a cylindrical shape and an outer end portion where a plurality of legs are formed and arranged in a cylindrical form by a plurality of slits.

Furthermore, the device for clearing pipe blockage further includes releasing means which makes a reverse flow of air possible by the one-way valve in order to make the air get out of the inflatable balloon.

According to the present invention, the device for clearing pipe blockage can maintain the airtight state of the pipe which has the blocked pipe, because the inflatable balloon is inserted from the inlet to the inside of the pipe or comes into contact with the inlet of the pipe. Therefore, due to pressure by expansion of the inflatable balloon and shock and pressure generated by movement, the blocked part of the pipe can be effectively cleared.

That is, after the inside of the pipe is set to be in a perfect airtight state, when pressure is supplied to the inside of the pipe, sufficient pressure can be applied to the blocked part of the pipe. Moreover, not only by the pressure but also by movement of the cylinder connected with the inflatable balloon, pressure generated by the movement can be applied to the blocked part of the pipe. Therefore, a sufficient external force is applied to the blocked part of the pipe, and hence, the blocked part of the pipe can be effectively cleared.

Furthermore, when the guide member comes into contact with the outside of the inlet of the pipe or comes into contact with the inner surface of the inlet of the pipe, the inflatable balloon can expand to the inlet of the pipe in a better state, and it can minimize a loss of pressure formed by the pumping unit.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Figure 1:
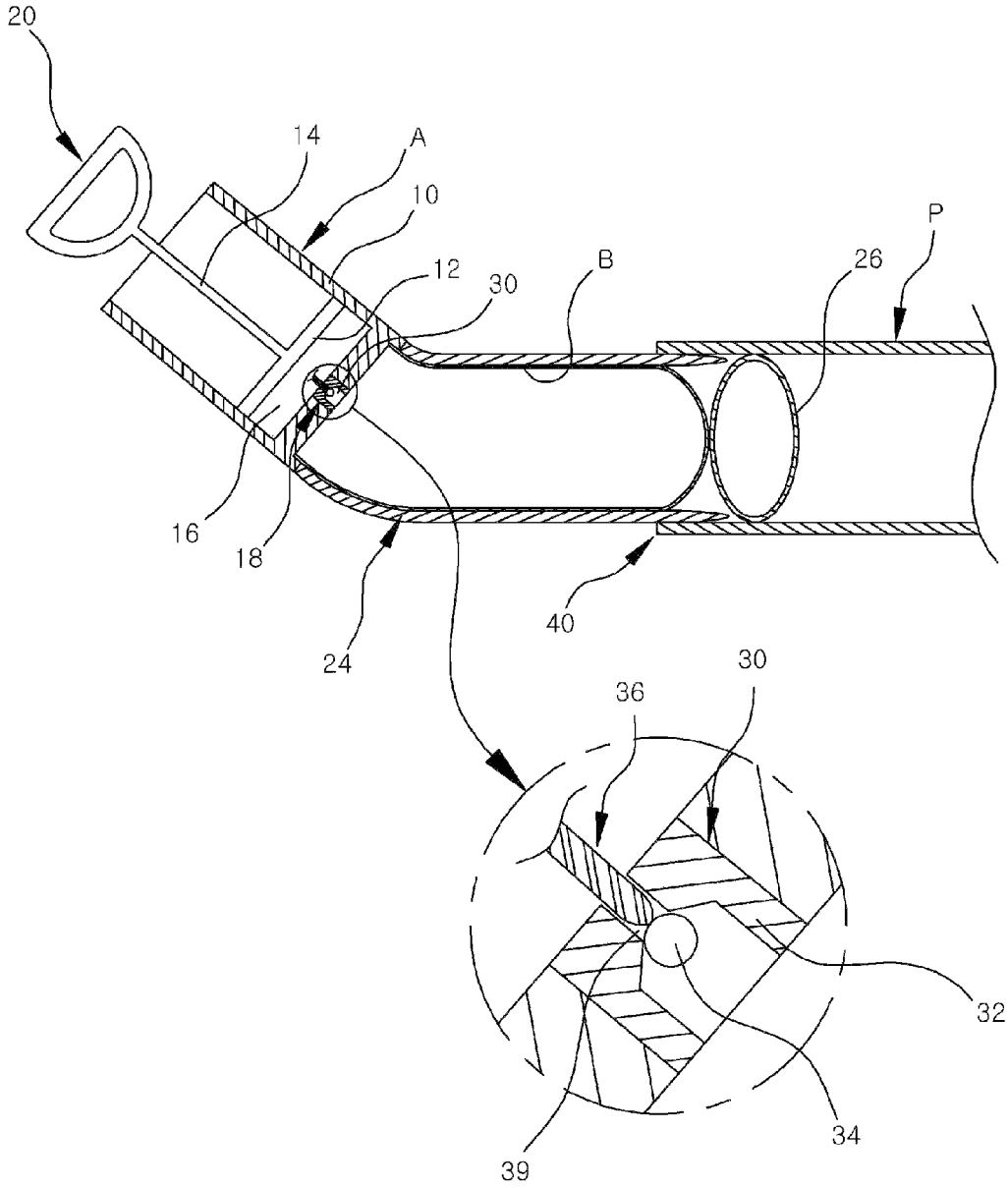
FIG. 1 is a sectional view showing the basic principle of a device for clearing pipe blockage according to a first preferred embodiment of the present invention.

Reference will be now made in detail to the preferred embodiments of the present invention with reference to the attached drawings. First, a first preferred embodiment of the present invention illustrated in FIG. 1 will be described. The device for clearing the pipe blockage according to the present invention uses a flexible inflatable balloon (B). The inflatable balloon (B) expands by injection of air and is returned to its original size when air is removed.

When the expanding inflatable balloon (B) is inserted into the inside of a pipe (P), high pressure may be formed between the inside of the pipe (P) and a blocked part, or shock pressure may be generated by a back-and-forth movement of the inflatable balloon (B) inserted into the pipe. It is obvious that the shock pressure formed by the movement of the inflatable balloon inside the pipe or the high pressure formed by expansion of the inflatable balloon can be a spur to clear the blocked part of the pipe (P).

The inflatable balloon (B) is expanded in a state where it is put to a predetermined distance inside the pipe from an inlet 40 of the pipe. Therefore, the inflatable balloon (B) goes into the pipe (P) through the inlet 40 and the outside of the inflatable balloon (B) comes into contact with the inside of the inlet 40 of the pipe to maintain airtightness. In the state where the inflatable balloon (B) completely gets in contact with the inner wall of the pipe (P) and maintains sufficient airtightness, relatively high pressure can be formed inside the pipe (P) while the balloon advances to the inside of the pipe by expansion of the balloon (B). Moreover, in the above state, shock pressure can be generated inside the pipe (P) by the back-and-forth movement (shaking) of the balloon (B).

The balloon (B) is expanded into the pipe while being supported by a guide member 24. In the first preferred embodiment illustrated in FIG. 1, the guide member 24 is configured to expand the balloon (B) in a state where a front end part of the guide member is inserted into the pipe (P) to a predetermined depth. The guide member 24 will be described in detail later.

Now, means for expanding the inflatable balloon (B) will be described. The device for clearing the blockage according to the present invention includes: the flexible inflatable balloon (B); and a pumping unit (A) which is connected with the balloon (B) to inject air to the inside of the balloon. The balloon (B) is expanded by the action of the pumping unit (A).

The pumping unit (A) includes: a cylinder 10 which has a cylindrical space therein; and a piston 12 which performs a reciprocating motion inside the cylinder. The cylinder 10 serves as a housing having a compressive space which compresses air while the piston 12 performs the reciprocating motion. Moreover, a piston rod 14 extending to the rear of the piston 12 is connected with a hand-grip 20, such that the inside air of the compressive space 16 is compressed at a predetermined pressure when the piston 12 performs the reciprocating motion through the hand-grip 20.

Furthermore, the piston 12 of a disc type performs a vertically reciprocating motion on the inner surface of the cylinder 10 to compress air, and in this instance, if necessary, a packing for preventing leakage of air may be mounted on the outer surface of the piston 12. The compressive space 16 formed inside the cylinder 10 has an outlet 18 to let the air out of the compressive space. Here, a one-way valve 30 is mounted at the outlet 18 through which the air compressed in the compressive space 16 gets out.

The outlet 18 formed at a lower end portion of the cylinder 10 is connected with the inflatable balloon (B) to be able to communicate with the inflatable balloon (B). That is, the inflatable balloon (B) is connected with the outlet 18 to be provided with compressed air generated by a motion of the piston 12 inside the cylinder 10.

Moreover, by the one-way valve 30 mounted at the outlet 18 to supply the inside air of the compressive space 16 to the inflatable balloon (B), the inside air of the compressive space 16 can be transferred to the inflatable balloon (B) only through the one-way valve 30. Here, the one-way valve 30 is defined as a generic term of valve tools which are configured to transfer a flow of air just in one direction and not to transfer the flow of air in the reverse direction. That is, referring to FIG. 1, the one-way valve is the valve which transfers air in the direction of the inflatable balloon (B) inside the compressive space 16 of the cylinder 10 but automatically stops a flow of air from the balloon (B) to the compressive space (16).

Such a one-way valve 30 may be, for instance, a check valve which is mounted on a flow path of a fluid to let the fluid flow just in one direction. Besides the above, valves of various forms may be realized. For instance, a valve which has a membrane mounted at one side of an air hole in such a way as to be opened relative to a flow of air in one direction but to be closed relative to a flow of air in the reverse direction. Alternatively, a valve used in a ball, such as a soccer ball, a volley ball or a basketball, may be also used.

The air supplied to the inside of the inflatable balloon (B) using the one-way valve 30 can be discharged out by manipulation of the one-way valve 30. For instance, in a case that the check valve or the membrane is used, when a tool is inserted into an air inlet of the balloon (B), the air inside the balloon can be discharged out. Even though another form of the one-way valve 30 is used, it is natural that the air can flow in the reverse direction when a user manipulates the valve 30 from the outside, and it will be described later.

The device for clearing the pipe blockage according to the present invention includes the guide member 24 for guiding the inflatable balloon (B) to the inside of the pipe. As shown in FIG. 1, the guide member 24 is configured in such a way that a front end portion of the guide member 24 can be inserted into the pipe (P) and that the inflatable balloon (B) can expand inside the pipe (P).

That is, the guide member 24 is formed, for instance, in the same cylindrical shape as the cylinder (A) and may be changed in size according to sizes of an inner pipe, and the balloon (B) is supported inside the guide member 24. An upper end portion of the guide member 24 is connected with the cylinder 10 to be supported, and for instance, the upper end portion of the guide member 24 is connected with the cylinder 10 to be able to be attached and detached. Moreover, the balloon (B) is joined and supported inside the guide member 24, or may be directly joined and supported to the cylinder 10.

It is preferable that the guide member 24 be molded of a flexible material, such as rubber or synthetic resin. Furthermore, a lower end portion of the guide member 24, which is a portion inserted into the pipe, is more flexible than the upper end portion, which is the portion connected with the cylinder. For instance, if the lower end portion of the guide member 24 is formed thinner than the upper end portion, the lower end portion becomes more flexible than the upper end portion. Additionally, as described above, when the lower end portion is molded to be more flexible, the guide member 24 can be easily inserted into the pipe (P), and the lower end portion which is located inside the pipe (P) by the expanding balloon (B) comes into close contact with the inner surface of the pipe (P) easily to maintain an airtight state.

Moreover, the device for clearing the pipe blockage further includes a presser 26 attached to the front end portion of the inflatable balloon (B). As described above, during the process that the balloon (B) moves forward inside the pipe (P) while expanding, the presser 26 removes foreign matters existing inside the pipe while moving together with the balloon (B) in a state where the presser 26 gets in contact with the inner surface of the pipe (P).

The presser 26 may be made of various materials, for instance, may be formed into a ball made of rubber, silicon or synthetic resin with elasticity. In a case that the presser 26 is molded into an elastically transformable ball type, because the presser 26 can get in contact with the inner surface of the pipe (P) while elastically transforming depending on changes in the inner diameter of the pipe (P), it could be suggested that the presser 26 provides better cleaning effect. Moreover, it is natural that the presser 26 can be molded of any material which is capable of being elastically transformed and cleaning in the state where the presser 26 gets in close contact with the inner surface of the pipe (P).

Next, the operation of the device for clearing the pipe blockage having the above structure will be described. For instance, when the inside of the pipe, such as a trap structure, is blocked, the user can use the device for clearing the blockage according to the present invention. First, the front end portion of the guide member 24 is inserted into the pipe (P) to a predetermined distance. Because the guide member 24 is molded of a flexible material and the lower end portion of the guide member 24 is more flexible, the guide member 24 can be inserted into the inlet 40 of the pipe more smoothly.

In the above state, when the user manipulates the hand-grip 20 (vertically), the air is compressed in the compressive space 16 which is located at the lower part of the piston 12 while the piston 12 performs a vertical movement, and then, passes through the outlet 18, namely, the one-way valve 30. Furthermore, the air passing the one-way valve 30 goes into the inflatable balloon (B). That is, the inflatable balloon (B) expands by the action of the pumping unit (A).

When the inflatable balloon (B) expands, the balloon (B) comes into contact with the inner surface of the pipe (P) to maintain airtightness from the outside in the state where the guide member 24 is interposed between the balloon (B) and the pipe (P). Additionally, when the action of the pumping unit (A) is repeated, the inflatable balloon (B) expands, and the front end portion of the balloon (B) moves forward inside the pipe (P) by the expansion of the balloon (B). By the expansion of the balloon (B), the presser 26 moves in front of the balloon (B). In addition, when the presser (26) moves forward, the inner surface of the pipe (P) is cleaned, and the balloon (B) moves forward along the inner surface of the cleaned pipe (P) to a predetermined distance.

It is natural that the forward movement of the balloon (B) by expansion applies pressure to the inside of the pipe. Therefore, relative high pressure can be transferred to the blocked part of the pipe. When the user moves the pumping unit (A) in the back and forth direction or in the lateral direction while grasping the pumping unit (A) in the state where the inflatable balloon (B) is expanded sufficiently, shock by the movement inside the pipe to which high pressure is applied can be transferred to the blocked part. As described above, when the pressure transferred to the inside of the pipe by the balloon (B) and the shock by the movement of the balloon are transferred to the blocked part of the pipe, the blocked part can be cleared sufficiently by a resultant force of the pressure and the shock.

When the blocked part of the pipe is cleared, the process to remove the air of the balloon (B). The air of the balloon can be removed when the user manipulates the one-way valve. Manipulation of the one-way valve can be achieved in various forms as follows.

The enlarged part of FIG. 1 shows an example that the one-way valve 30 includes a valve body 32 having an air flow path and a check ball 34 mounted at the valve body 32 to pass the air only in one direction. As described above, the one-way valve 30 allows that the air is induced into the balloon (B) along the outlet 18 by the action of the piston and the check ball 32 stops a flow of the air in the reverse direction.

Here, in order to remove the air of the balloon (B), for instance, a release wire 36 is inserted into the air flow path 39 to apply power to the check ball 34 to change the position of the check ball. That is, when the check valve 30 is separated from the air flow path 39, the inside air of the balloon (B) can be discharged out along the air flow path 39. Besides the above, in order to remove the air of the balloon (B), of course, there are various structures, and, in fact, such structures are to allow the flow of air in the reverse direction through manipulation of the one-way valve.

The release wire 36 may be configured to be interlocked with the piston 12, the piston rod 14 or the hand-grip 20, and it is also natural that the release wire 36 can be mounted in such a way that the user can manipulate it through the connection structure with the cylinder 10.

In the preferred embodiment illustrated in FIG. 1, it is described that the guide member 24 is joined to or detachably connected to the cylinder 10. However, the guide member 24 and/or the balloon (B) may be directly joined to the cylinder 10 in a detachable manner, but it is also possible that the guide member 24 and/or the balloon (B) may be detachably mounted to a casing or a cover which is joined or detachably connected to the cylinder 10.

Figure 2:
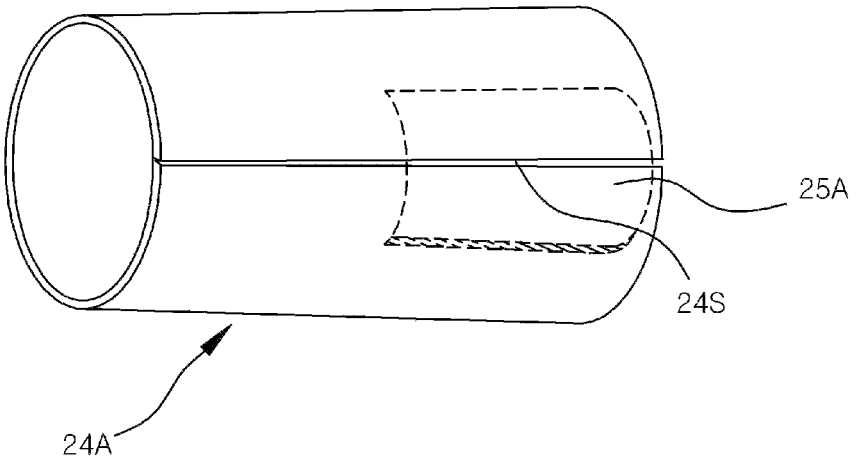
FIG. 2 is a perspective view showing an example of a guide member according to the first preferred embodiment of the present invention.

As described above, the front end portion of the guide member 24 is inserted into the pipe (P), and in the above state, comes into close contact with the inner surface of the pipe (P) by expansion of the balloon (B). Here, the guide member 24 may be molded by a cylindrical-shaped member, or as shown in FIG. 2, may be molded by rolling a sheet of a member in a cylindrical shape. Such a guide member 24A has a slit 24S formed in the longitudinal direction.

That is, the guide member 24A is generally formed in a cylindrical shape and has the slit 24S which separates the guide member at a part in the longitudinal direction. The guide member 24A having the slit 24S can get in contact with the inner surface of the pipe (P) more closely while the slit 24S is opened when the guide member 24A is expanded inside the pipe of a large diameter. Moreover, when the guide member 24A enters into the pipe of a smaller diameter, some parts of the guide member 24A are overlapped with each other. In the above embodiment, it is not desirable that the slit 24S is opened and the balloon (B) is exposed through the open part. Therefore, preferably, an auxiliary guide 25A is fixed at one side of the slit 24S to cover the open part when the slit 24S is opened.

Figure 3:
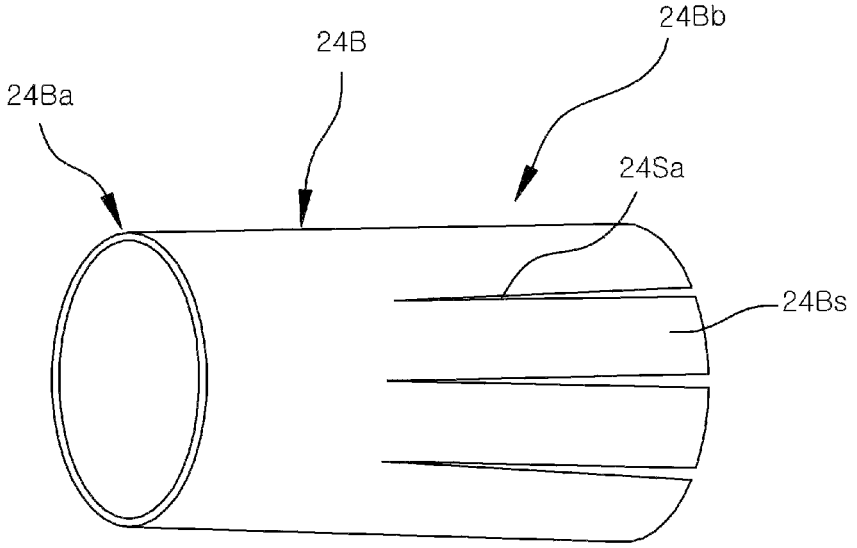
FIG. 3 is a perspective view showing another example of the guide member according to the first preferred embodiment of the present invention.

FIG. 3 illustrates a guide member 24B according to another example of the present invention. The guide member 24B includes: an inside end portion 24Ba which is connected with the cylinder 10 and is formed in a cylindrical shape; an outside end portion 24Bb which is formed in the opposite side and has a plurality of slits 24Sa; and a plurality of legs 24Bs formed by the slits 24Sa. The guide member 24B is formed in a cylindrical shape. The guide member 24B can come into contact with the inner surface of the pipe (P) more easily by expansion of the balloon (B) even inside the pipe of the larger diameter. When the guide member 24B is inserted into the pipe of the smaller diameter, the legs are overlapped with each other, such that the guide member 24B can come into contact with the inner surface of the pipe. Here, in the case that the legs are overlapped, in order to enhance contact to the balloon (B), both sides of the legs become gradually thinner so that the guide member 24B generally has uniform thickness even at the overlapped parts.

As described above, the guide member 24 is generally made of a flexible material. It is obvious that the guide member can be designed in various forms, such as a straight form or a rectangular form, according to the structure or surrounding conditions of the blocked pipe. FIG. 1 shows a state where the guide member 24 is bent at an angle of about 45 degrees.

Next, referring to FIG. 4, a device for clearing pipe blockage according to a second preferred embodiment of the present invention will be described. The second preferred embodiment is identical with the first preferred embodiment in the general configuration, but in the second preferred embodiment, the guide member 24 comes into contact with the inlet 40 of the pipe which corresponds to the outside of the pipe.

Figure 4:
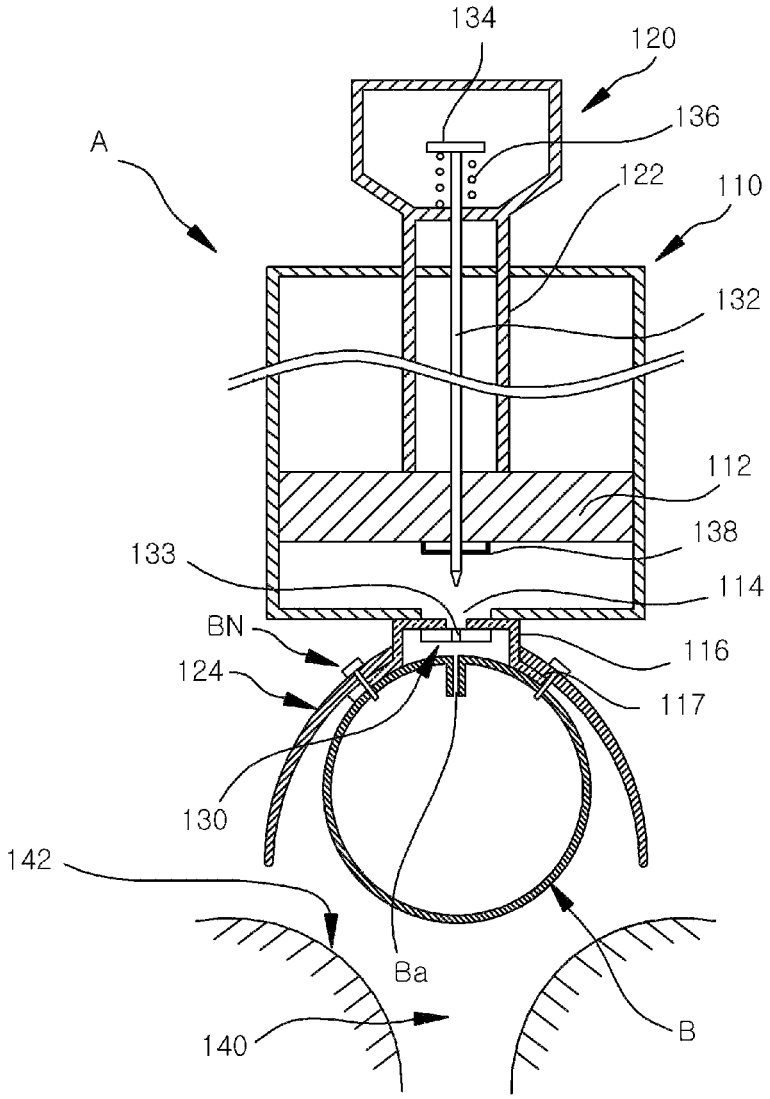
FIG. 4 is a sectional view showing a device for clearing pipe blockage according to a second preferred embodiment of the present invention.

As shown in FIG. 4, the device for clearing pipe blockage according to the second preferred embodiment of the present invention includes: an inflatable balloon (B); and a pumping unit (A) which is connected with the balloon (B) to inject air into the balloon.

The pumping unit (A) includes: a cylinder 10 which has a cylindrical space therein; and a piston 112 which performs a reciprocating motion inside the cylinder. The cylinder 10 has an outlet 114 formed at a lower end portion thereof to let the air get out.

The outlet 114 is formed through a central portion of a neck part 116 protruding downward. The piston 112 is connected with a piston rod 122 extending upward, and a hand-grip 120 is formed at an upper end portion of the piston rod 122. Furthermore, the inflatable balloon (B) is connected to the outlet 114 formed at the lower end portion of the cylinder 110 to be able to be communicated with the outlet 114.

The outlet 114 and the balloon (B) are connected with each other through a one-way valve 130. According to this embodiment, a guide member 124 is mounted on the outer face of the inflatable balloon (B). As shown in the drawing, the guide member 124 may be formed in a hemispherical shape or in a partially spherical shape to surround the inflatable balloon (B). The guide member 124 is connected to the cylinder 110 to be supported, and for instance, is connected to the neck part 116 to be supported. The guide member guides the inflatable balloon (B) to expand in an exact direction and helps that the inflatable balloon (B) gets in contact with the inlet of the pipe at the time of an initial aiming.

Here, it is possible that the guide member 24 is made of a flexible material and comes into contact with the outer surface of the inlet 140 of the pipe. That is, in this embodiment, the guide member 124 is not inserted into the pipe to a predetermine depth but comes into contact with the outer surface 142 of the inlet 140 of the pipe to maintain airtightness of the inside of the pipe.

Next, the operation of the device for clearing the pipe blockage having the above structure will be described. First, the guide member 124 comes into contact with the inlet 140 of the pipe. After that, when the user manipulates the hand-grip 120 (in the vertical direction), the inside air of the cylinder 110 is compressed and moves toward the outlet 114 while the piston 112 performs a vertical movement. The air escaping the outlet 114 can go into the inside of the inflatable balloon (B) through the one-way valve 130.

When the above action is continued, in fact, the inflatable balloon (B) expands, and the expanding balloon (B) comes into contact with the inlet 140, and then, goes into the pipe. Here, when the inflatable balloon (B) comes into contact with the inlet 140, it is natural that the inside of the pipe is in an airtight state from the outside.

Because the inflatable balloon (B) is made of the flexible material, such as rubber or silicon, to expand when air is injected into the balloon after the inflatable balloon (B) comes into contact with both sides of the inlet 140, the inflatable balloon (B) goes into the pipe. When the inflatable balloon (B) goes into the pipe, pressure is applied to the inside of the pipe, and the next process is the same as the first preferred embodiment.

According to this embodiment, a radially extended flange 17 is formed integrally at the lower end portion of the neck part 116 connected to the bottom surface of the cylinder 110, and the guide member 24 and the inflatable balloon (B) are fixed through the flange 17. For instance, the flange 17, the guide member 24 and the inflatable balloon (BO are fixed at once by a bolt and a nut (BN). The neck part 16 connected to the lower portion of the center of the cylinder 10 may be formed separately or integrally with the cylinder 10.

When the blocked part of the pipe is cleared, the process to remove the air of the balloon (B) is carried out. For this, a release wire 132 which is inserted into an air flow hole 133 of the one-way valve 130 is mounted through the inside of the piston rod 122. An upper end portion 134 of the piston rod 122 is elastically supported in the upward direction by a spring 136 in a state where it is located inside the hand-grip 120.

When the user presses the upper end portion 134, the lower end portion of the piston rod 122 is inserted into an air injection hole 132 of the one-way valve 130 mounted above the inflatable balloon (B) so as to control a flow of the air in the reverse direction. Moreover, a packing member 138 is mounted at the lower end portion of the piston 112 through which the release wire 132 passes to prevent the compressed air from backing up through the part where the wire member 132 is mounted.

Also in this embodiment, it is natural that the substantive operation is the same as the first preferred embodiment. As described above, the device for clearing pipe blockage according to the present invention makes the inflatable balloon (B) expand and get in contact with the inside of the inlet of the pipe to clear the blocked part of the pipe by supplying pressure to the inside of the pipe.

It will be understood by those skilled in the art that various modifications and equivalents can be made without departing from the technical spirit and scope of the present invention and the protective scope of the present invention is interpreted based on the matters described in the appended claims.

What is claimed is:

1. A device for clearing pipe blockage comprising:

pumping means which can compress air by pumping and has an outlet for discharging compressed air out;

an inflatable balloon which is mounted at the outlet and expands by air discharged through the outlet;

a one-way valve which is mounted at the outlet to supply the air compressed by the pumping means to the inflatable balloon and to stop a flow of the air in the reverse direction; and a guide member which is formed in a cylindrical shape to surround the outside of the inflatable balloon, guides the inflatable balloon expanding by the pumping means to move forward inside a pipe, and is made of a flexible material, wherein the inflatable balloon expanding by the pumping means expands to the inside of the pipe, which is blocked, to maintain an airtight state at an inlet of the pipe, so that the blocked pipe is cleared by shock pressure by movement of the pumping unit and a change in pressure by expansion of the inflatable balloon by the compressed air.

2. The device for clearing pipe blockage according to claim 1, wherein the inflatable balloon expands in a state where the guide member is inserted into the inlet of the pipe to a predetermined length.

3. The device for clearing pipe blockage according to claim 1, wherein the inflatable balloon expands in a state where the guide member comes into contact with the inlet of the pipe.

4. The device for clearing pipe blockage according to claim 1, further comprising:

a presser which is mounted at a front end portion of the inflatable balloon to clean the inner surface of the pipe while moving in a state where it gets in contact with the inner surface of the pipe.

5. The device for clearing pipe blockage according to claim 1, wherein the guide member is formed in a cylindrical shape which has a slit formed in the longitudinal direction and includes an auxiliary guide attached to the inside of the slit to cover an open part of the guide member when the guide member is opened by the slit, such that the guide member can be used widely regardless of sizes of the pipe.

6. The device for clearing pipe blockage according to claim 1, wherein the guide member has an inner end portion formed in a cylindrical shape and an outer end portion where a plurality of legs are formed and arranged in a cylindrical form by a plurality of slits.

7. The device for clearing pipe blockage according to claim 1, further comprising:

releasing means which makes a reverse flow of air possible by the one-way valve in order to make the air get out of the inflatable balloon.

* * * * *